US010955203B2

(12) United States Patent
Efrat

(10) Patent No.: US 10,955,203 B2
(45) Date of Patent: Mar. 23, 2021

(54) CLEANING A MULTI-EFFECT EVAPORATOR

(71) Applicant: I.D.E. TECHNOLOGIES LTD., Kadima (IL)

(72) Inventor: Tomer Efrat, Kadima (IL)

(73) Assignee: IDE TECHNOLOGIES LTD., Kadima (IL)

( * ) Notice: Subject to any disclaimer, the term of this patent is extended or adjusted under 35 U.S.C. 154(b) by 254 days.

(21) Appl. No.: 15/775,379

(22) PCT Filed: Nov. 8, 2016

(86) PCT No.: PCT/IB2016/056709
§ 371 (c)(1),
(2) Date: May 10, 2018

(87) PCT Pub. No.: WO2017/081602
PCT Pub. Date: May 18, 2017

(65) Prior Publication Data

US 2018/0372434 A1 Dec. 27, 2018

(30) Foreign Application Priority Data

Nov. 10, 2015 (GB) ..... 1519844

(51) Int. Cl.
*F28G 9/00* (2006.01)
*F25B 39/02* (2006.01)

(52) U.S. Cl.
CPC ..... *F28G 9/00* (2013.01); *F25B 39/02* (2013.01)

(58) Field of Classification Search
CPC .. F28G 9/00; F28G 9/005; F25B 39/02; F25B 47/00; F25B 47/003
(Continued)

(56) References Cited

U.S. PATENT DOCUMENTS 1,581,545 A * 4/1926 Prache ..... B01D 1/12 159/47.1
2,788,065 A * 4/1957 Lockman ..... F28G 9/00 159/20.2
(Continued)

FOREIGN PATENT DOCUMENTS

GB 1011603 A 12/1965
GB 1497429 A 1/1978
(Continued)

OTHER PUBLICATIONS

International Search Report dated Feb. 2, 2017.

*Primary Examiner* — Tho V Duong
*Assistant Examiner* — Raheena R Malik
(74) *Attorney, Agent, or Firm* — Fresh IP PLC; Clifford D. Hyra; Aubrey Y Chen

(57) ABSTRACT

A method and system for cleaning a multistage evaporator, the evaporator having a normal operational mode and a cleaning mode and having at least two groups of effects (2, 4), each group having one or more effects. In a normal operational mode, input vapor is introduced to a first group of effects (2), the first group comprising the hottest effects, and then vapor is delivered from the first group to a second group of effects (4), and optionally, from the second group of effects to a third group of effects (6) and so on depending on the total number of effects. Upon detection of a predetermined level of scale formation in the first group of effects, the evaporator is switched to a cleaning mode wherein the first group of effects (2) is physically separated from the other groups of effects and the input vapor is re-directed into the second group of effects (4). A cleaning agent is introduced into the physically separated first group of effects (2) until a predetermined level of cleanliness is achieved.

14 Claims, 4 Drawing Sheets

(58) Field of Classification Search
USPC ..... 165/51; 159/17.1
See application file for complete search history.

(56) References Cited

U.S. PATENT DOCUMENTS

| | | | | | |
|---|---|---|---|---|---|
| 2,801,824 | A * | 8/1957 | Taprogge | F28G 1/12 | 165/95 |
| 3,245,460 | A * | 4/1966 | Loebel | B01D 1/26 | 159/24.1 |
| 4,476,917 | A * | 10/1984 | Otake | F28G 1/12 | 165/95 |
| 5,021,096 | A * | 6/1991 | Abadi | C02F 5/08 | 134/22.14 |
| 5,137,081 | A * | 8/1992 | Klaren | F28G 1/12 | 15/3.5 |
| 5,830,314 | A * | 11/1998 | Mattsson | B01D 1/26 | 159/17.1 |
| 5,964,982 | A | 10/1999 | Roller et al. | | |
| 6,258,206 | B1 * | 7/2001 | Olausson | D21C 11/06 | 159/13.2 |
| 7,413,634 | B1 * | 8/2008 | Napier | B01D 3/146 | 202/153 |

FOREIGN PATENT DOCUMENTS

| | | | |
|---|---|---|---|
| GB | 2443802 | A | 5/2008 |
| WO | WO2011/032237 | A1 | 3/2011 |

* cited by examiner

CLEANING A MULTI-EFFECT EVAPORATOR

This invention relates to an improved method and system for cleaning a multi-effect evaporator.

TECHNICAL FIELD

Multiple-effect evaporators use the heat from steam to evaporate water. Water is evaporated in a sequence of effects, each held at a lower pressure than the last. The evaporation temperature of water decreases as pressure decreases, so vapor evaporated in one vessel can be used to heat the next, and only the first vessel (at the highest pressure) requires an external source of heat. This is called multi-effect evaporation. Multiple-effect evaporators are widely used in all industrial applications where large volumes of water must be evaporated, such multi-effect distillation for the desalination of sea water.

Different types of evaporator exist such as multi-stage flash (MSF) evaporators and mechanical-vapour-compression evaporators (MVC) but all involve a series of stages with a cold end and a hot end with one or more intermediate stages between the two ends.

Multiple effect evaporation is frequently accompanied by the formation of scale on the feed side of one or more of the evaporator effects. This reduces the heat transfer coefficient and hence the capacity of the evaporator. Scale deposits can be difficult to remove and generally require shut down of the plant with a consequential loss of production so that chemicals or other means may be used to remove the deposits. This is clearly detrimental to the overall efficiency of the plant.

It is an object of the present invention is to provide an improved method for cleaning a multistage evaporator that aims to overcome, or at least alleviate, the abovementioned drawbacks.

It is a further object of the present invention to provide an improved multi-effect evaporator that aims to overcome, or at least alleviate, the abovementioned drawbacks.

SUMMARY OF THE INVENTION

A first aspect of the present invention provides a method for cleaning a multistage evaporator while minimizing the related shutdown duration, the evaporator having a normal operational mode and a cleaning mode and having at least two groups of effects, each group having one or more effects, the method comprising:

- introducing input vapor to a first group of effects, the first group comprising the hottest effects; and
- delivering vapor from the first group to a second group of effects; and optionally, delivering vapor from the second group of effects to another group of effects and so on dependent upon the total number of groups of effects, during a normal operational mode;

the method further comprising:

- a cleaning mode comprising physically separating the first group of effects from the second and optionally, other groups of effects, at periodic intervals;
- re-directing the input vapor into the second group of effects during physical separation of the first group of effects; and
- introducing a cleaning agent into the physically separated first group of effects until a predetermined level of cleanliness is achieved.

The method preferably further comprises physically re-joining the first group of effects to the second and optionally, other groups of effects, once the predetermined level of cleanliness has been achieved and re-directing the input vapor back to the first group of hottest effects to resume the normal operational mode.

It is preferable for the method to comprise physically sealing the first group of hottest effects from the second and optionally, other groups, to provide physical separation of the first group of effects.

The second group of effects generally comprises the group of effects nearest to the first group of hottest effects. It is to be appreciated that each group of effects may comprise a single effect or multiple effects. Thus, the method may involve three effects; a hot effect, an intermediate effect and a cold effect or multiple effects comprising a hot effect, multiple intermediate effects and a cold effect. Alternatively, multiple effects may be provided in each group of effects. Parallel feeding of each effect, or group of effects, may be provided wherein fresh feed is delivered to each effect, or group of effects, and concentrated feed is withdrawn from each effect or group of effects. The vapour from each effect is still used to heat the next effect.

The method may further comprise closing at least one opening or aperture that allows fluid communication between a chamber housing the first group of effects and a chamber housing the second and optionally, other groups of effects, to physically separate the first group of effects from the second and optionally, other groups of effects. For example, a movable part may be provided to physically close the opening or aperture, for example in the form of a valve or tap.

Alternatively, the method may further comprise closing at least one shutter provided between the first group of effects and the second and optionally, other groups of effects, provided within a single chamber to physically separate the first group of effects from the second and optionally, other groups of effects, within the single chamber.

The method further comprises opening a valve, for example in the form of a tap, provided between the input line and the second group of effects to re-direct input vapor to the second group.

According to a second aspect of the present invention, there is provided a multi-effect evaporator having a normal operational mode and a cleaning mode, the evaporator comprising:

- a vapor compressor;
- at least two groups of effects, each having one or more effects, the first group comprising the hottest group of effects;
- an input inlet for introducing vapor to the first group of effects;
- pipework for delivering vapor from the first group of effects to the second group of effects and, optionally, from the second group of effects to another group of effects and so on dependent upon the total number of groups of effects, during a normal operational mode;
- wherein the first group of effects is configured for its temporary physical separation from the second and optionally, other groups of effects, and the input inlet is interchangeable to introduce vapor directly from the compressor to the second group of effects during the physical separation of the first group of effects from the second and optionally, other group of effects, to provide a cleaning mode.

The first groups of effects may be provided with a secondary inlet for the delivery of a cleaning agent to the first group of effects during the cleaning mode.

Preferably, a control unit is provided to switch the multi-effect evaporator from the normal operational mode to the cleaning mode when a predetermined level of scaling is detected in the first group of effects and/or to switch the multi-effect evaporator from the cleaning mode to the normal operational mode when a predetermined level of cleanliness is detected in the first group of effects.

In one embodiment, the hottest effect is placed in a first chamber and the second and optionally, other groups of effects, are provided in a second chamber, the chambers being connected by an opening that is sealable with a moveable part, such as a valve or tap, to allow temporary physical separation of the first group of effects.

Alternatively, the groups of effects may be provided in a single chamber provided with movable shutter (350) for sealing part of the chamber containing the first group of effects from the chamber containing the second and optionally, other groups of effects, to allow temporary physical separation of the first group of effects.

Preferably, the second group of effects is provided with at least two interchangeable vapor inlets, the first inlet directing vapor from the first group of effects to the second group of effects during normal operational mode of the evaporator and a second inlet directing vapor from the input inlet directly to the second group of effects during the cleaning mode of the evaporator.

It is to be appreciated that each group of effects may comprise a single effect or a plurality of effects. The groups of effects may have different numbers of effects.

BRIEF DESCRIPTION OF THE DRAWINGS

Embodiments of the invention shall now be described, by way of example only, with reference to the accompanying drawings in which.

DETAILED DESCRIPTION

The present invention relates to an improved method of cleaning multi effect evaporator and to an evaporator having a normal operational mode and a cleaning mode.

Figure 1:
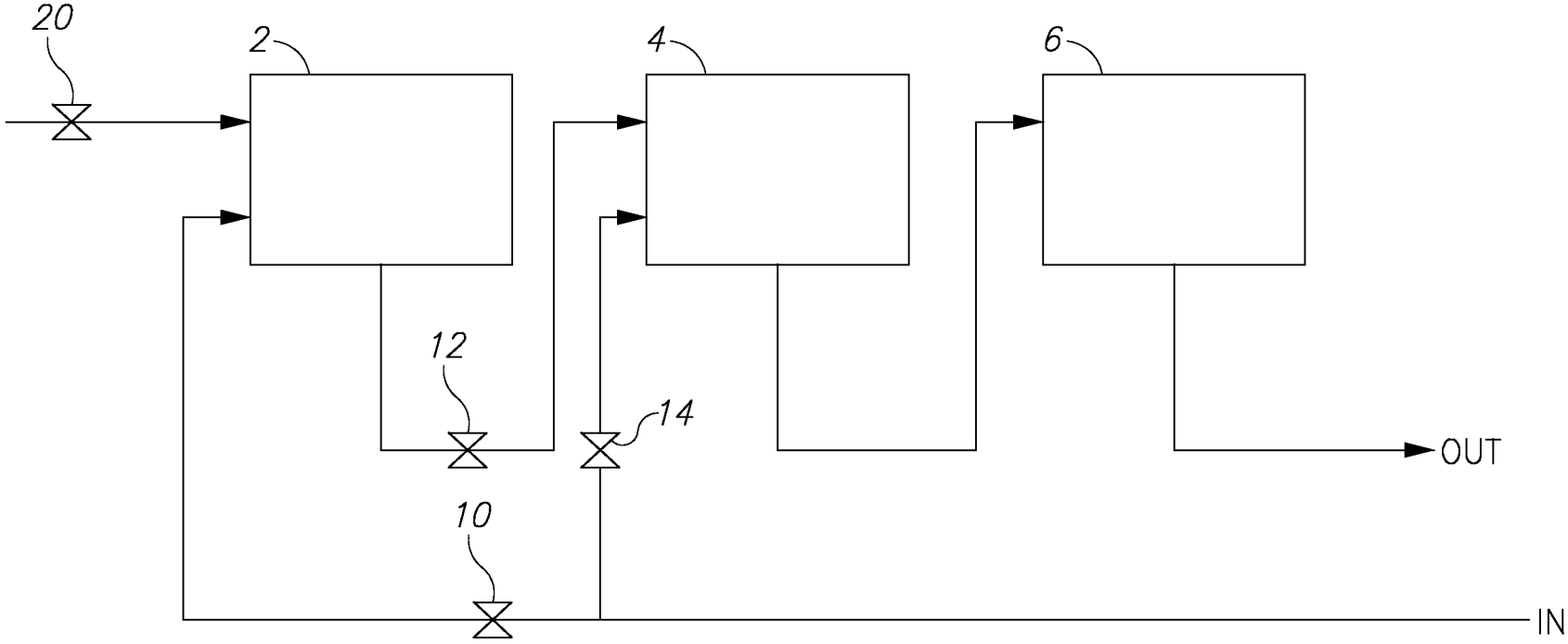
FIG. 1 is a schematic diagram of a multi effect evaporator according to one embodiment of the present invention.

FIG. 1 of the accompanying drawings provides a schematic drawing of a multi-effect evaporator according to one embodiment of the present invention. The evaporator has an input stream for delivering hot feed water, such as sea water, to a first effect 2 (or group of effects). Water is evaporated in the effect and the vapour is delivered to the next effect (or group of effects) 4 which is held at a lower pressure than the last. The boiling temperature of water decreases as pressure decreases, so vapor evaporated in one vessel can be used to heat the next. Vapor produced in the second effect 4 then passes to a third effect (or group of effects) 6 before the final product is removed from the system.

It is to be appreciated that three effects, or group of effects, are shown in the accompanying figures but the evaporator may include more effects, or groups of effects or only two effects or groups of effects, i.e. a hot and a cold effect or group of effects.

The first group of effects (or single effect) is subjected to the hottest temperatures and thus scale formation is greatest in this group/effect. Therefore, the present invention provides the evaporator with a cleaning mode wherein the first effect or group of effects are physically separated from the other groups of effects at periodic intervals. This is achieved by shutting of the taps 10, 12 and opening of tap 14 so that the input stream is redirected into the second effect or group of effects 4 with the first effect, or group of effects, being isolated from the rest of the evaporator. A cleaning agent is then introduced into the physically separated first group of effects (2) by opening a tap 20 in a cleaning agent fluid line until a predetermined level of cleanliness is achieved.

Once a predetermined level of cleanliness has been achieved in the first effect (or first group of effects) the taps 20 and 14 are shut and taps 10 and 12 re-opened so that the input stream is re-directed back to the first group of hottest effects (2) to resume the normal operational mode.

Figure 2:
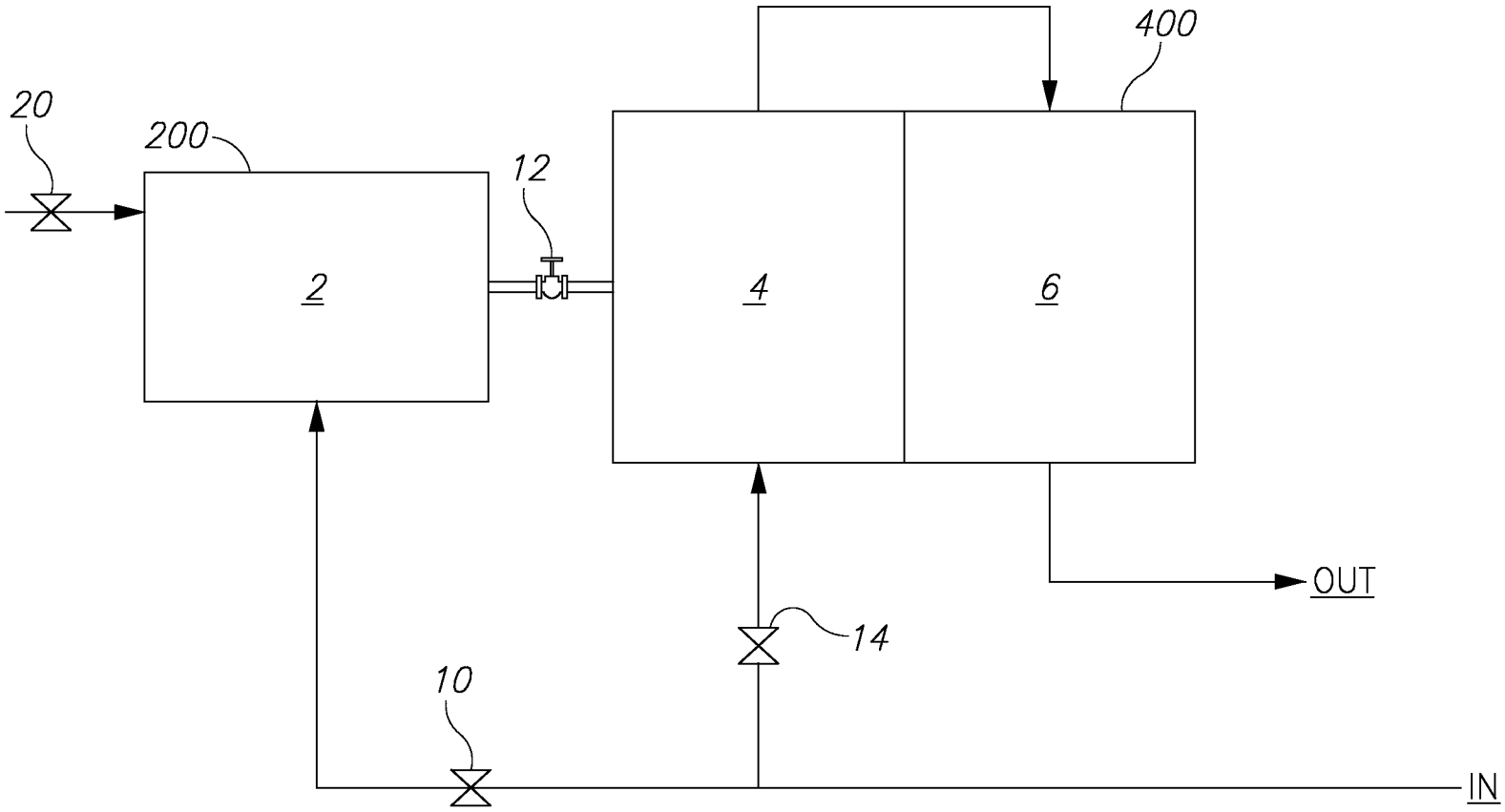
FIG. 2 is a schematic diagram of a multi effect evaporator according to another embodiment of the present invention.

FIG. 2 illustrates one embodiment for providing the physical separation between the hottest effect, or group of effects 2, and the adjacent or second effect 4. The hottest effect 2 is provided in a separate chamber 200 and the second and further effects (or group of effects) are housed within another chamber 400. The chambers 200, 400 are connected by pipework that is sealable with a tap 12 to allow temporary physical separation of the first group of effects from the second and subsequent group of effects. In this manner, during normal operation, the taps 10 and 12 are open and tap 14 is shut so that the input stream passes feed into the first group of effects 2 and vapor passes from the first group along the pipeline to the second group of effects 4 and from the second group of effects to the third groups of effects 6. In the cleaning mode, taps 10 and 12 are shut and tap 14 opened thereby redirecting the input stream directly into the second group of effects 4 housed in the second chamber 400. Bypassing of the chamber 200 enables the first group of effects, which will experience the worst scaling, to be cleaned by introducing cleaning agent by opening a separate cleaning fluid pipeline having tap 20.

The apparatus preferably includes a control unit (not shown) which monitors scale build-up in the first effect, or group of effects, to switch the multi-effect evaporator from the normal operational mode to the cleaning mode when a predetermined level of scaling is reached and/or to switch the multi-effect evaporator from the cleaning mode to the normal operational mode when a predetermined level of cleanliness is detected in the first group of effects.

Figure 3A:
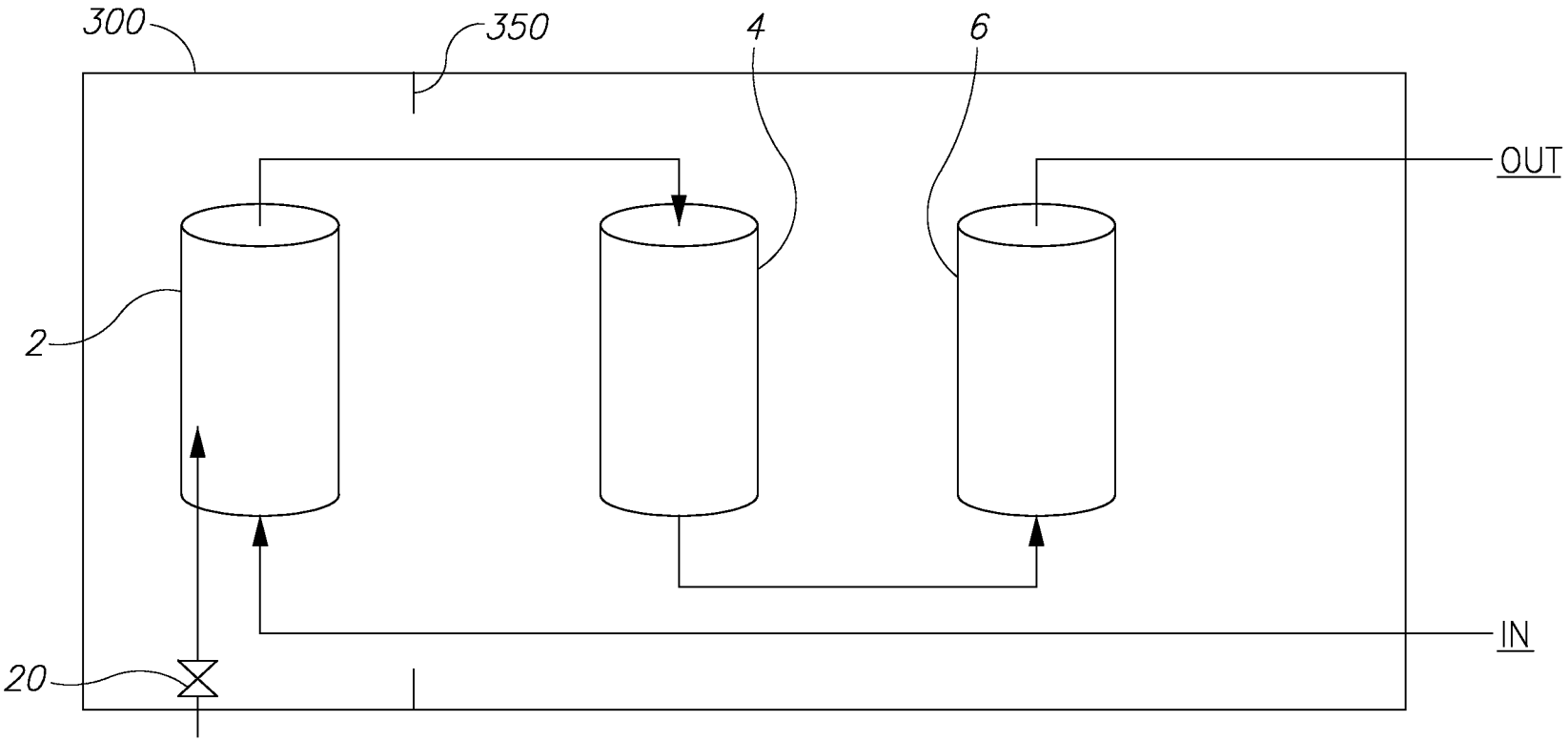
FIGS. 3*a* and 3*b* are schematic diagrams of a multi effect evaporator according to yet another embodiment of the present invention, shown in a normal operational mode and a cleaning mode respectively.
Figure 3B:
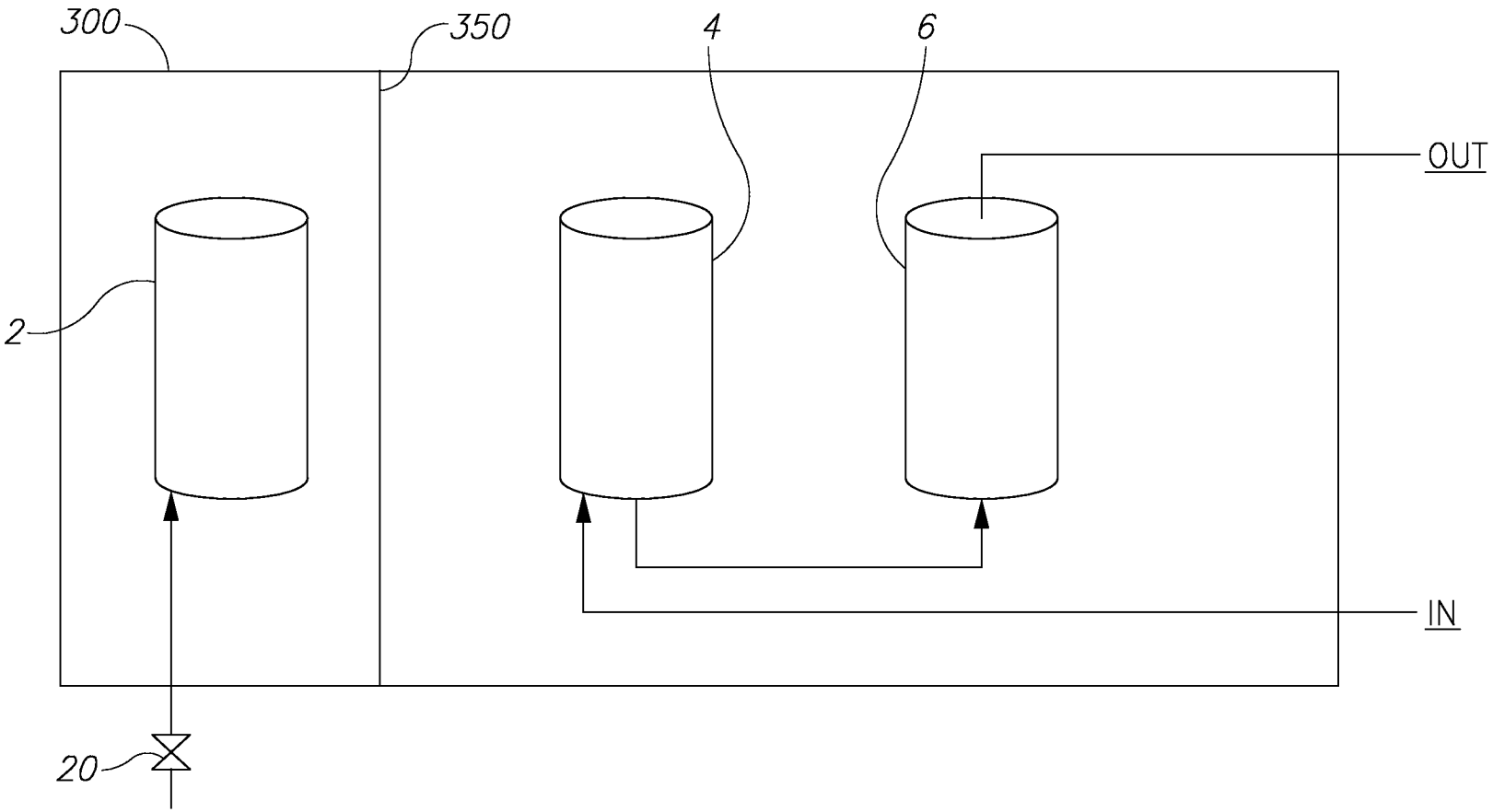

FIGS. 3*a* and 3*b* illustrate another embodiment of the present invention wherein the at least three effects, or groups of effects, are provided in a single chamber 300 which has means, such as a slidable shutter, for sealing the first part of the chamber housing the first effect, or group of effects 2 from the second and third effect, or group of effects 4,6. FIG. 3*a* shows the shutter in the open configuration and the evaporator is able to perform in the normal operational mode with feed being delivered to the first effect 2 before the second and then third effects. When a predetermined level of scaling is detected in the first effect (or group of effects), the evaporator is switched into cleaning mode causing the shutter to shut and seal off the part of the chamber 300 that contains the first effect (or group of effects) to allow temporary physical separation of the first group of effects from the other effects, as shown in FIG. 3*b*. This part of the chamber can then be cleaned while the other part of the chamber, containing the other effects, or group of effects, continues to operate normally.

The invention claimed is:

1. A method for cleaning a multistage evaporator, the evaporator having a normal operational mode and a cleaning mode and having at least a first group of effects and a second group of effects, each group having one or more effects, the first group of effects and the second group of effects being provided within a single chamber, a shutter being provided within the chamber to physically separate the first group of effects from the second group of effects, wherein in the operational mode, input vapor is introduced to the first group of effects, the first group of effects comprising the hottest effects; and vapor is delivered from the first group of effects to the second group of effects within the chamber; the method of cleaning comprising:

In the cleaning mode, physically separating the first group of effects from the second groups of effects by shutting the shutter; re-directing the input vapor into the second group of effects during physical separation of the first group of effects; and introducing a cleaning agent into the physically separated first group of effects.

2. A method as claimed in claim 1, further comprising physically re-joining the first group of effects to the second group of effects, once a predetermined level of cleanliness has been achieved, and re-directing the input vapor back to the first group of hottest effects to resume the normal operational mode.

3. A method as claimed in claim 1, wherein the second group of effects comprises the group of effects nearest to the first group of hottest effects.

4. A method as claimed in claim 1, wherein input vapor is supplied on an input line, the method further comprising opening a valve provided between the input line and the second group of effects to re-direct input vapor to the second group of effects.

5. A method according to claim 1, comprising at least one further group of effects, the normal operational mode and cleaning mode comprising delivering the vapor from the second group of effects to the third group of effects within the chamber.

6. A method as claimed in claim 1, wherein each of the one or more effects is held at a different pressure than any other effect in the one or more effects.

7. A multi-effect evaporator having a normal operational mode and a cleaning mode, the evaporator comprising:

At least a first group of effects and a second group of effects, each having one or more effects, the first group comprising the hottest group of effects; the first group of effects and the second group of effects being provided within a single chamber, an input inlet for introducing vapor to the first group of effects and wherein vapor is delivered from the first group of effects to the second group of effects within the chamber; wherein in the operational mode, input vapor is introduced by the input inlet to the first group of effects, the first group of effects comprising the hottest effects; and vapor is delivered from the first group of effects to the second group of effects; and wherein to provide a cleaning mode a shutter is provided within the chamber to physically separate the first group of effects from the second group of effects, the input inlet is operable to introduce vapor to the second group of effects during the physical separation of the first group of effects from the second group of effects, and the first group of effects is provided with a secondary inlet for the delivery of a cleaning agent to the first group of effects during the cleaning mode.

8. A multi-effect evaporator as claimed in claim 7 wherein a control unit is provided to switch the multi-effect evaporator from the normal operational mode to the cleaning mode when a predetermined level of scaling is detected in the first group of effects and/or to switch the multi-effect evaporator from the cleaning mode to the normal operational mode when a predetermined level of cleanliness is detected in the first group of effects.

9. A multi-effect evaporator as claimed in claim 7, wherein the second group of effects comprises the group of effects nearest to the first group of hottest effects.

10. A multi-effect evaporator as claimed in claim 7, comprising an input line to supply input vapor to the input inlet, and a valve provided between the input line and the second group of effects to re-direct in vapor to the second group of effects.

11. A multi-effect evaporator as claimed claim 7, comprising at least one further group of effects, wherein vapor is delivered from the second group of effects to the third group of effects within the chamber.

12. A multi-effect evaporator as claimed in claim 7, further comprising a vapor compressor to supply input vapor to the input inlet.

13. A multi-effect evaporator as claimed in claim 12, wherein the vapor compressor is a thermos-compressor, mechanical or other vapor compressor.

14. A multi-effect evaporator as claimed in claim 7, wherein each of the one or more effects is held at a different pressure than any other effect in the one or more effects.

* * * * *